US006230596B1

(12) United States Patent
Reinders

(10) Patent No.: US 6,230,596 B1
(45) Date of Patent: May 15, 2001

(54) METHOD OF AND APPARATUS FOR CONVEYING FLAT PIECES OF A WEB

(75) Inventor: Peter Reinders, Ochtrup (DE)

(73) Assignee: Schmale-Holding GmbH & Co., Ochtrup (DE)

( * ) Notice: Subject to any disclaimer, the term of this patent is extended or adjusted under 35 U.S.C. 154(b) by 0 days.

(21) Appl. No.: 09/349,277

(22) Filed: Jul. 7, 1999

(30) Foreign Application Priority Data

Jul. 16, 1998 (DE) ..... 198 31 992

(51) Int. Cl.[7] ..... B26D 7/06; B65H 35/00

(52) U.S. Cl. ..... 83/27; 83/23; 83/206; 83/277; 83/76.8; 83/80; 83/153; 83/155; 83/453; 83/937; 271/265.01; 271/176

(58) Field of Search ..... 83/202, 206, 276, 83/277, 23, 27, 76.8, 79, 80, 428, 452, 404.1, 151, 153, 155, 437.1, 453, 936, 937; 271/265.01, 267, 84, 69, 176, 198; 226/1, 15, 16, 18, 19, 35, 36, 45, 109, 115, 138, 158, 162, 170, 172

(56) References Cited

U.S. PATENT DOCUMENTS

| | | | | |
|---|---|---|---|---|
| 3,722,435 | * | 3/1973 | eLSAS | 83/404.1 X |
| 3,797,348 | * | 3/1974 | Moore | 83/209 |
| 3,823,629 | * | 7/1974 | Bleimund | 83/277 X |
| 3,831,472 | * | 8/1974 | Sasaki | 83/277 X |
| 4,519,595 | * | 5/1985 | Adachi | 83/937 X |
| 5,193,424 | * | 3/1993 | Minichshofer et al. | 83/937 X |
| 5,375,493 | * | 12/1994 | Focke et al. | 83/277 X |
| 5,445,053 | * | 8/1995 | Kallner | 83/23 |

* cited by examiner

*Primary Examiner*—Boyer Ashley
(74) *Attorney, Agent, or Firm*—Herbert Dubno

(57) ABSTRACT

An apparatus for advancing positions of a web material has a first transporter at which the pieces are separated from a web, a clamp which transfers the pieces to the plane of a second transporter and a second transporter operating in this plane in a direction orthogonal to the displacement direction of the first transporter. The second transporter has at least one conveyor at least part of which is movable toward and away from the clamp and toward which the clamp can be moved so that the pieces are transferred to the conveyor and can be displaced by the latter with no spacing between them or with only a limited spacing between them.

18 Claims, 4 Drawing Sheets

9
II
2
8
4
2
2
5
5a
7d
7a
P1
4a
7
7c
7
P2
2
3
7b
3
10
1'
10
II
11

METHOD OF AND APPARATUS FOR CONVEYING FLAT PIECES OF A WEB

FIELD OF THE INVENTION

My present invention relates to an apparatus for the transport of a flat piece of material, for example, a piece cut from a web of textile material, of paper, of paperboard, of cardboard, of plastic or synthetic resin, a metal strip or of a foil and wherein the piece is originally supplied along a first transport path by a first transporter and is then transferred to a second transporter. The invention also relates to a method transporting such pieces. To the extent that the invention has method aspects, the method may also be considered a method of operating the apparatus.

BACKGROUND OF THE INVENTION

In the transport of such pieces of sheet or web material, especially pieces cut from a continuous web of material and, in particular textile pieces cut from a web of a textile, it is known to provide a first discontinuously operable transport device by means of which a textile web is withdrawn from a supply, e.g. a roll, and that the free end of this web, pieces are cut off. The pieces can be then transferred to a second continuously operable transporter whose transport plane runs parallel to the transport plane of the first transporter.

The free end of the web can be engaged to pull the web out before it is cut off in the first plane and the web can be displaced in the second plane transversely to its displacement in the first plane, i.e. orthogonal to the first direction of displacement. The means for engaging the free end of the web may be tongs and the tongs can tension the web for cutting. The first transporter can also include a slider shiftable in the first direction. Between the transport slider and the transport tongs of the first transporter, the separating device can be provided for cutting the piece off the web.

The transfer means can engage the cut off piece and displace the latter between the plane of the first transporter and the plane of the second transporter.

In the prior art apparatus which operates in the manner described, especially for textile material, as soon as one textile piece is displaced away from the area in which it is severed from the textile web another piece can be separated from the web and similarly transported away.

One of the drawbacks of such an arrangement is that during the time interval in which a piece of material is being transported away from the location at which it is separated from the web, a further piece of material cannot be cut from the web and hence the cutting can only occur after the previously cut piece has been completely carried off from this region.

With such an arrangement, especially with a continuously driven second transporter, the successive textile pieces cannot be delivered so that they are practically touching one another, i.e. with a quasi gap-free succession as may be required for seaming and sewing stations. Rather there always remains between the individual textile pieces along the second path, a comparatively large gap which limits the utilization of the apparatus in terms of the number of delivered pieces per unit time and can have a negative effect on equipment downstream of the transporters, i.e. apparatus for processing the pieces.

Apparatus is also known which is capable of transporting pieces first in one direction and then in a direction orthogonal thereto and in which the two planes in which the pieces are moved by the respective transporters are located one above the other. In these systems, the textile pieces may be engaged on needle bars which deliver the textile pieces to needle chains. The material is repeatedly engaged or pierced by the needle which can be detrimental to the fabric and operations in the vicinity of such needle bars and needle chains may be dangerous. In many cases neither needle bars nor needle chains can be used.

With such apparatus as well, it is not possible to ensure the continuous delivery of pieces of material in a quasi-gap-free or spacing-free manner.

OBJECTS OF THE INVENTION

It is, therefore, the principal object of the present invention to provide an improved apparatus for the transport of pieces of web material in which injury to the material can be minimized or avoided and which permits the delivery of a succession of pieces touching one another or practically touching one another, i.e. in at least a quasi-gap-free manner so that the utilization of the apparatus can be maximized and the operations of subsequent machinery for processing such pieces can be made more efficient.

Another object of the invention is to provide an improved method of transporting pieces whereby drawbacks of earlier methods are avoided.

It is also an object of this invention to provide a highly reliable apparatus which can be of relatively simple construction, and which can efficiently deliver a succession of flat workpieces.

SUMMARY OF THE INVENTION

These objects and others which will become apparent hereinafter are attained, in accordance with the invention, in an apparatus in which the second transporter is a continuously operating belt, band or chain conveyor with at least one endless conveyor element and preferably two such conveyor elements spaced apart from one another transversely to their directions of displacement. Each of the conveyor elements is juxtaposed with a strip-like support surface parallel to the conveyor direction, i.e. the direction of movement of a stretch of the conveyor element adapted to displace a piece of material between itself and the support surface and which may be an edge of a fabric piece. Each conveyor element can be provided with a buffer loop which expands or contracts depending upon the movement of an upstream return loop, the latter being movable counter to the transport direction toward the clamping means in which the piece of material is engaged for transfer to the second plane. This end of each conveyor element is thus displaceable from an initial position counter to the transport direction and parallel thereto into a receiving position in which it engages the piece of material and draws it in the transport direction on the support surface.

The second transporter thus comprises a continuously operating strip-like conveyor, which need not be formed as a circulating conveyor element but also can be provided in the form of a nonclosed reversibly driven band segment.

With such conveyor elements or two such transversely-spaced conveyor elements, the piece of material can be pressed against the respective strip-like supporting surfaces and transported away.

The spacing between the conveyor elements can be adjusted to accommodate different widths of the piece material, i.e. to displace pieces of different widths.

Since the conveyor elements have respective buffer loops, the upstream ends of the conveyor elements may be moved back and forth counter to and in the displacement direction (parallel to the displacement plane defined by the supporting surfaces). In this case, each oncoming piece is engaged substantially earlier than is the case with a stationary continuously driven conveyor. After the pick-up of a piece of the web material, the upstream end of the conveyor, by its entrainment with the piece of material itself, can be displaced back into its initial position to make place for the delivery of a further piece of material and a repetition of the process. For the displacement of the material which entrains the upstream end of the conveyor element for the upstream ends of the conveyor elements in the second direction, further conveyor elements can be provided alongside the first-mentioned conveyor elements.

Alternatively, the second transporter can be a continuously-driven belt, band or chain-like conveyor with at least one conveyor element, but preferably two such conveyor elements which are transversely spaced from one another, whereby each of these conveyor elements is juxtaposed with a strip-like support surface. Each of these conveyor elements can be bodily displaced counter to the transport direction from an initial position into a receiving position.

Since the complete conveyor element with its drive roller and deflection roller is shifted counter to the direction of advance of the pieces of material while the conveyor element continues to be driven, for reception of the successive pieces, the successive pieces can practically touch one another as they are advanced along the second transport path. The conveyor element or conveyor elements can be returned to the initial position during the further travel of the pieces. This arrangement has certain advantages over the first alternative. The apparatus according to the invention can thus comprise:

a first transporter for displacing a succession of flat pieces of a web along a first path in a first direction;

a second transporter defining a second path parallel to the first path for receiving the flat pieces and displacing the received flat pieces in a second direction perpendicular to the first direction; and clamping means engageable with the flat pieces at a location along the first path for transferring the flat pieces to the second path for engagement by the second transporter, the second transporter comprising:

a strip-shaped support extending in the second direction away from a location along the second path at which the flat pieces are transferred from the first path to the second path, a continuously driven conveyor element having a stretch traveling in the second direction and running along the support for entraining the flat pieces along the support, and means for displacing at least an upstream part of the conveyor element toward the location along the second path for receiving a transferred flat piece on the second transporter.

The conveyor element can have a buffer loop and a return loop at an upstream side of the stretch, the means for displacing shifting the return loop parallel to but opposite to the second direction from an initial position to a position for receiving the transferred flat piece on the second transporter.

Alternatively, the entire continuously driven conveyor element is displaceable parallel to but opposite to the second direction from an initial position toward the location and back along the second path for receiving a transferred flat piece on the second transporter.

Preferably, parallel to the first-mentioned conveyor element of the second transporter, are respective further conveyor elements forming a second continuously operating conveyor and disposed close to the conveyor elements which are shiftable between the initial position of the piece-receiving position. These additional conveyor elements can be driven at the same speed and in the same direction as the first-mentioned conveyor elements and entrain the piece to draw the return loop portion of the first conveyor elements back into the initial positions after they have received a piece of the web material.

With this construction the first conveyor element or conveyor elements can receive a piece of the web material from the clamping means at the upstream end of the second transporter and the second conveyor elements close to the first conveying elements and preferably outwardly flanking same, can take over displacement of the piece to allow the piece to draw the return loop back into its initial position. As a result there is no significant relative movement between the first conveyor elements and the piece and the first conveyor elements are returned to the initial positions without slip between the first conveyor elements and the piece. Furthermore, it allows the return loop at least of each first conveyor element to be returned to the receiving position to pick up the next piece before the previous piece has fully cleared the return position. As a consequence, the successive pieces can be engaged by the first conveyor elements of the second transporter significantly earlier than can be the case in earlier systems and the pieces can be closer together as they are displaced by the conveyor elements of the second transporter.

Preferably both continuously operating conveyor elements are endless elements driven in a single direction and continuously.

The conveyor elements can be cog belts which mesh with cog wheels serving as deflection or idler rollers and as drive rollers.

The closely neighboring elements of the first and second conveyors can be provided with a common drive so that the drive serves to synchronize the two conveyor elements of each pair with one another and with the pair of other conveyor elements and to ensure that the stretches of all of the conveyor elements described with the support are uniformly driven in the same direction.

When the conveyor element has a so-called buffer loop, the conveyor element can be looped around two rollers, one of which can be fixedly located while the other can be moved back and forth parallel to the second plane.

Each conveyor element can thus be provided with a first roller around which the return loop extends and is looped around a second roller and a third roller to form the buffer loop in the form of a double-backed portion of the conveyor element, the first roller and one of the second and third rollers being movable jointly for shifting of the return loop parallel to but opposite to the second direction from the initial position to the position for receiving the transferred flat piece on the second transporter.

According to another feature of the invention, the means for displacing at least an upstream part of the conveyor element includes an effector connected to a controller or controlled by a controller for detecting a pattern of the flat piece and a setpoint position of the flat piece under the stretch of the conveyor moving in the second direction.

According to still another feature of the invention the means for displacing at least an upstream part of the conveyor element includes an effector connected to a controller or controlled by a controller for detecting the position of one of the flat pieces beneath the stretch of the conveyor element of the second transporter.

The position detection device can be a photo cell arrangement, a so-called light curtain, or some other contactless device or proximity sensor. The detection element can, for example, detect the passage of the trailing edge of the piece of the web or the leading edge of the next oncoming piece or in the case in which the first conveyor has its upstream end shiftable toward and away from the clamping means, the trailing edge of the piece engaged by the first conveyor to exactly position the edge vertically below the axis of rotation of the roller for the return loop. The next piece can thus be advanced to this edge so that, to the extent desired, gap-free or approximately gap-free transport of successive pieces is possible.

The invention also comprises an apparatus for forming and conveying flat pieces of a textile web which comprises:

a first transporter including a tongs engageable with a leading edge of a textile web and a transport slider for displacing the textile along a first path in a first direction in one plane;

separating means along the first path for severing flat pieces from the web whereby a succession of the flat pieces from the web are displaced along the first path in the first direction;

a second transporter defining a second path parallel to the first path for receiving the flat pieces and displacing the received flat pieces in a second direction in a second plane parallel to the one plane and spaced therefrom, and perpendicular to the first direction; and clamping means engageable with the flat pieces at a location along the first path for transferring the flat pieces to the second path for engagement by the second transporter, the clamping means including pairs of clamps engaging respective flat pieces inwardly of but close to opposite edges of the flat piece, the clamps being engageable with each flat piece in the plane of the first path, being shiftable with the engaged flat piece into the plane of the second path, and being shiftable toward and away from the second transporter, the second transporter being shiftable toward and away from the clamping means.

The two transporters can be located one above the other, therefore, and in the upper plane the pieces can be cut off, for example, by a circular blade or a cutting beam.

Prior to the cutting, the workpiece which is to be cut off from the web can be engaged by the clamping device. The clamping device can then transport the cut off piece of fabric into the second transport plane and in this plane can be advanced to the second transporter. The cut off piece can be held close to its opposite edges and so that the edge portions of the cut off piece project slightly beyond the clamps. The clamps displace the cut off pieces and simultaneously, the second transporter can approach the clamping means from the opposite direction to pick up the pieces from the clamp.

The projecting edge portions can then be engaged by the conveyors of the second transporter to carry off the cut off pieces. The upstream end of the conveyors and the clamp can then be moved away from one another into the respective starting positions for the transfer of a cut off piece to the second transporter. In this position the second transporter is spaced from the clamping means. This opposite movement of the second transporter and the clamping device for the transfer pieces ensures that the leading edge of a subsequent piece will approach the trailing edge of a previous piece so that the succession of pieces is advanced in a quasi-gap-free or with minimum gap separation. With the invention, the possibility of damage to the workpieces by needles or the like is avoided.

Because of the proximity of successive pieces to one another the subsequent stations, for example sewing stations and/or seaming stations, can operate continuously with a high output.

Preferably, the second transporter comprises conveyor belts which are offset from alignment with the clamping members so that an overlap between the clamping members and the conveyor elements is possible at transfer of the pieces between the clamps and the conveyor elements.

The clamping bars and the transport conveyors should be closely adjacent one another so that the edges of the piece can be engaged by the transport conveyors while they are held in the clamps in a gap-free or approximately gap-free manner from piece to piece.

The strip-like support which is juxtaposed with each conveyor element can be a planar support plane or table or a further conveyor. In this case the support can be formed by an endless continuously driven conveyor having a stretch juxtaposed with the aforementioned stretches of the conveyor element and displaced at the same speed and in the same direction as the latter.

The method of the invention for forming the conveyor flat pieces can thus comprise the steps of:

(a) gripping a leading edge of a textile web and drawing the textile web in a first direction along a first path in a first plane;

(b) cutting a flat piece from the textile web on the first path in the first plane to define a trailing edge on the flat piece;

(c) engaging the flat piece by two pairs of clamping bars in the first plane with each pair of clamping bars gripping the flat piece inwardly of a respective one of the edges and extending perpendicularly to the direction;

(d) shifting the flat piece clamped by the pairs of clamping bars into a second plane parallel to but spaced from the first plane;

(e) moving the clamping bars with the flat piece clamped thereby in a second direction perpendicular to the first direction to displace the flat piece along a second path in the second plane and moving at least parts of a pair of continuously driven endless conveyor elements having stretches traveling in the second direction, opposite the second direction toward the clamping bars, and engaging the edges between the stretches and strip-like supports juxtaposed with the stretches; and (f) thereafter, releasing the flat piece from the clamping bars, moving at least the parts of the pair of continuously driven endless conveyor elements back to an initial position and continuing to displace the flat piece in the second plane in the second direction between the stretches and strip-like supports juxtaposed with the stretches.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
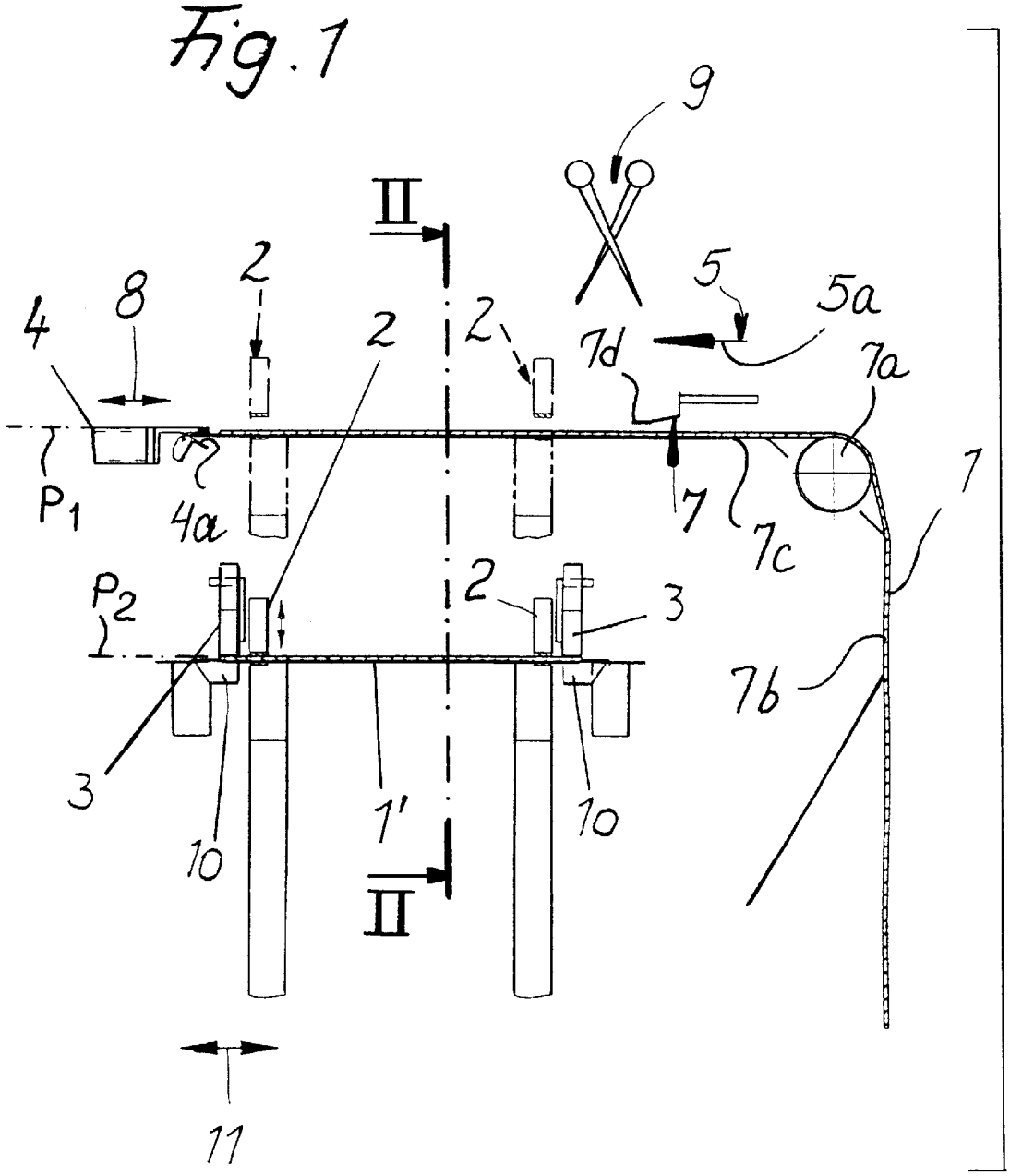
FIG. 1 is a side view partially in section of important elements of the apparatus of the invention.

FIG. 1 of the drawing shows some of the basic elements of an apparatus for formation of pieces of a web material, especially pieces of a textile web, for transporting them initially by a first transporter and then for subsequently delivering them with a second transporter.

The apparatus basically comprises a first discontinuously operating transporter by means of which a textile web is drawn from a storage thereof (not shown), for example a roll, over a roller 7*a* and along a guide 7*b*, upwardly onto a table or plate 7*c*. The leading edge can be engaged as will be described in greater detail hereinafter, to hold the web 1 taut in a first horizontal plane $P_1$, whereupon the piece 1' is cut off from the web and the web is displaced into a second horizontal plane $P_2$, parallel to the first plane, and advanced in a direction orthogonal to the direction of advance in the first plane. The individual pieces of fabric are represented at 1'.

The first transporter, as a whole, is represented at 5 and the first transport direction by the arrow 5*a*. To displace the web in this direction, a transport slider 7 is provided which has a shoe 7*d* which engages the fabric and, while the fabric is supported by the plate 7*c*, slides the fabric toward the transport tongs 4 whose fingers 4*a* can engage the leading edge of the web.

Figure 2:
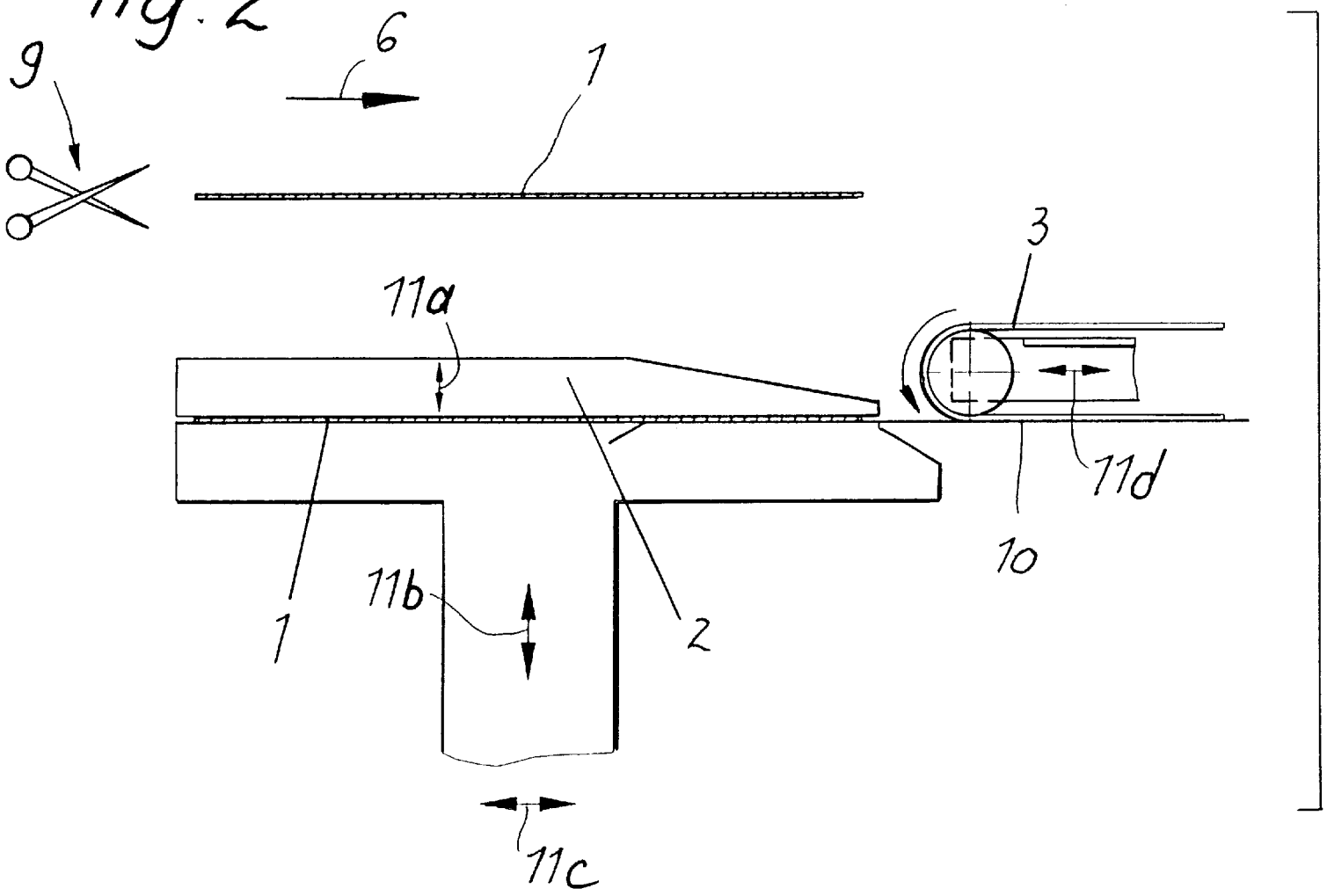
FIG. 2 is a view in section along line II—II of FIG. 1.

The transport direction of the second transporter has been represented by the arrow 6 in FIG. 2, this direction being perpendicular to the plane of the paper in FIG. 1.

As has already been noted, the transport planes $P_1$ and $P_2$ for the two transporters, are parallel to one another and spaced one above the other. The transport direction 5*a* of the first transporter 5 extends parallel to the length of the web 1 while the transport direction 6 of the second transporter is transverse to the length of the web.

The first transporter is thus comprised of the transport slider 7 and the transport tongs 4, the transport tongs 4 being movable toward the transport slider 7 and away therefrom as represented by the arrow 8.

Between the transport slider 7 and the transport tongs 4, in the region of the transport slider 5, there is provided a separating device 9 which can be a shear or cutting blade system which can cut off a textile piece 1' from the web. The separating means 9 in the embodiment shown in FIGS. 1 and 2 is a shear and the shear can be manually operated or can be a motor-driven slicing blade or a pneumatic or motor-driven cutting beam or the like. The textile pieces 1', after they have been separated from the web are displaced into the plane $P_2$ of the second transporter by a transfer means.

The transfer means can include a clamping device 2 which can include two pair of clamping beams. One of the beams of each pair is provided above the textile web 1 and the other beam is provided below the textile web 1, the textile pieces being engaged between the clamping beams of the two pair to fix the pieces in the clamp formed thereby.

The clamping beams can be displaceable from the broken line position shown in FIG. 1 to the solid line positions shown.

The clamping beams engage the textile pieces at short distances from their lateral edges so these lateral edges, which are oriented transversely to the transport direction 5 and represent the leading edge and the trailing edge of each piece in the first plane $P_1$, project laterally beyond the clamping beams.

The clamping device 2 can be shifted into the plane $P_2$ of the second transporter. The clamping device 2 with the clamping beams can be shifted toward the second transporter in plane $P_2$ and the second transporter can at least in part be shifted toward the clamp so that second transporter and the clamping device these elements approach one another and allow the transfer of the cut-off pieces to the second transporter.

The second transporter is comprised of conveyors 3, usually endless circulating belts. These belts have lower stretches which are juxtaposed with support surfaces 10. Since the clamping beams 2 are laterally offset from the conveyors 3 as is apparent especially from FIG. 1, the beams 2 and conveyors 3 can overlap one another when they move together without interference or contact. Because of this arrangement, the conveyors 3 can engage the projecting lateral edges of the piece 1 to allow subsequent pieces 1' to practically be contiguous with preceding pieces as they are advanced by the second transporter.

As soon as the second transporter has engaged each textile piece with its conveyors 3 and has begun to transport it away, the clamping unit 2 is shifted back into position to obtain another fabric piece while the conveyor 3 is displaced into its initial position so that a further textile piece can be engaged and delivered to the second transporter. The movements of the units 2 and 3 and, of course, the individual parts thereof has been indicated by the double-headed arrows 11, 11*a*, 11*b* and 11*c* and 11*d* in FIGS. 1, 2 and 3.

The support surface 10 which is juxtaposed with the conveyors 3 and along which the piece 1' can be displaced by the belt, is elongated opposite to the transport direction (i.e. to the left in FIG. 2), so that the edges of the textile pieces are placed on the support surfaces by the clamping bars 2 even before the textile piece 1' is within the operating range of the belts 3.

The tongs 4 and the clamping unit 2 can be pneumatically actuated. The transport belts 3 can be synchronously driven, for example, by electric motors or the like.

Figure 5:
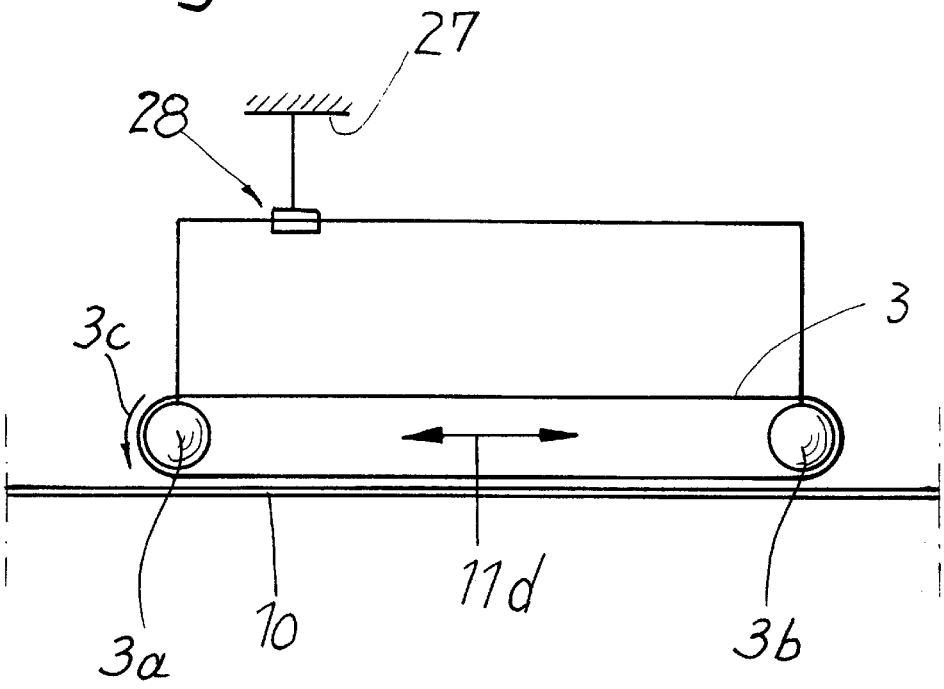
FIG. 5 is a diagram illustrating another embodiment of the invention.

FIG. 5 shows the adjustment possibility of the entire conveyor 3 of the second transporter. The lower pass or stretch of the conveyor element 3 is parallel to the support 10 and runs around deflecting rollers 3*a* and drive rollers 3*b*. The lower stretch of the conveyor element 3 is parallel to the support surface.

To receive a textile piece 1', the complete conveyor unit 3 is shifted to the left (FIG. 2), for example, by means of a linear actuator 28 which can for example be held on a housing 27. After or during the reception of a textile piece 1, the unit, which is contiguously driven as represented by the arrow 3*c* can be moved again to the right into its initial position (FIG. 5), the conveyor element 3 being continuously driven at a constant speed to advance the piece 1.

With this apparatus, it is possible to provide a method in which the individual workpieces or fabric pieces are advanced in a gap-free or with a limited gap to a further processing of the workpieces. The result is a close relationship between the successive pieces which maximize the delivery rate of the apparatus and allows subsequent operation stations to work more efficiently.

Figures 3, 4:
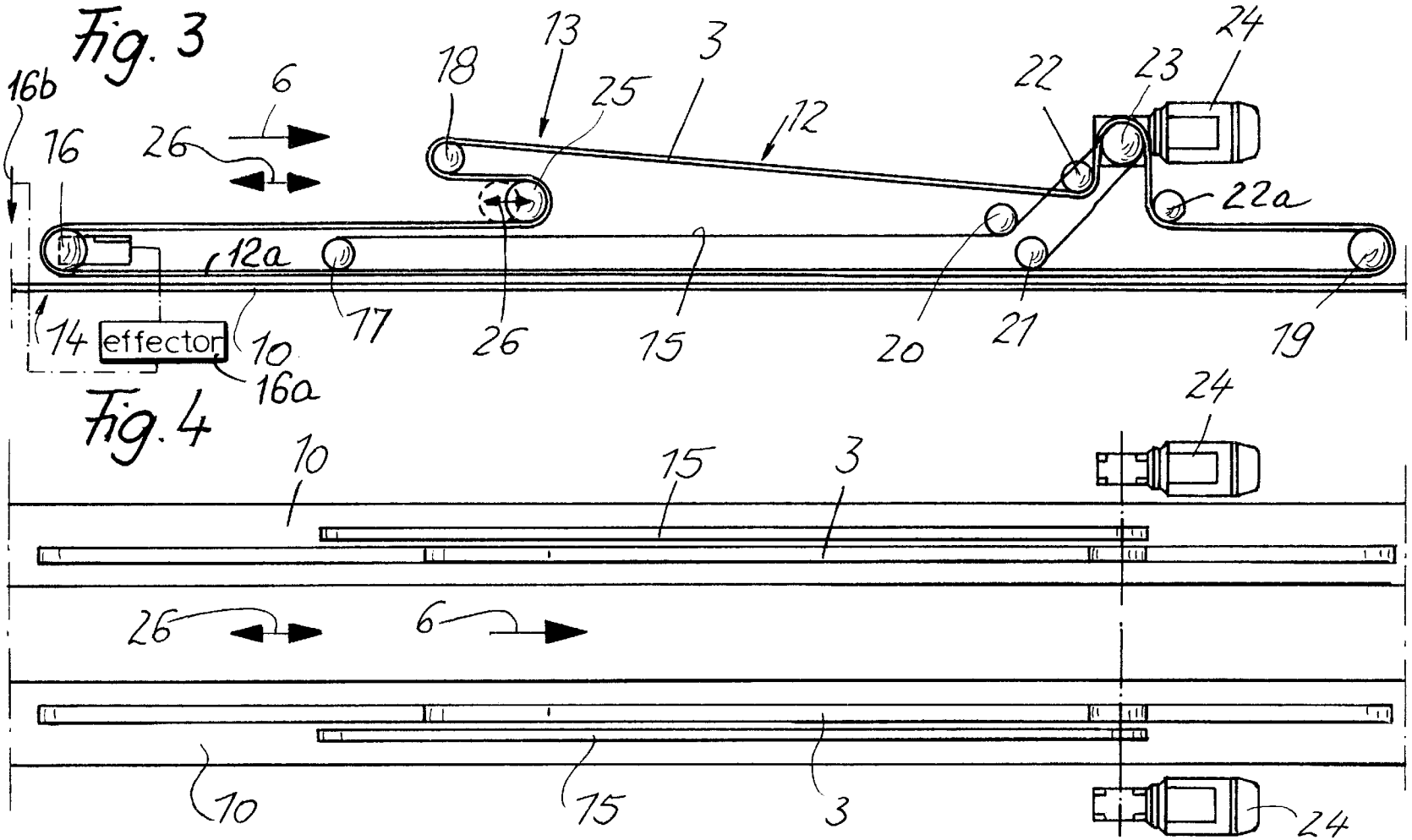
FIG. 3 is a side elevational view illustrating a detail of the apparatus, namely, conveyor elements thereof.
FIG. 4 is a plan view of the detail of FIG. 3.

In FIGS. 3 and 4, the conveyors 3 are shown in greater detail, these conveyors being a key to at least one aspect of the invention. The pieces 1' are displaced parallel to the support surfaces 10 after they are transferred from the first transporter to the second transporter and each of the conveyors 3, which are transversely spaced as can be seen in FIG. 4, can comprise a continuously driven conveyor belt 12. The conveyors 3 have lower horizontal stretches each of which runs parallel to the displacement direction 6 along the respective strip-like support 10 against which the lower stretch 12*a* holds the respective edge of the fabric piece and draws the latter along the surfaces 10. The support surfaces 10 can be upper stretches of continuously driven belts synchronized with the belts 12 and disposed below the belts 12. They can also be simple plates or tables.

Each of the conveyors 3 is formed with a buffer loop and has a return loop 14 extending around a roller 16. The roller 16 and hence the return loop is movable back and forth in the direction of arrow 26. The region between the initial position of the return loop and the position closest to the clamp 2 can be considered a reception region for the second transporter.

Parallel to each conveyor 3 and flanking conveyors 3 outwardly thereof, are further conveyors 15 looped around rollers 17 and guided by rollers 20 and 21. The conveyors 15 are driven by rollers 23 from motors 24.

The conveyor belts 15 grip the pieces of fabric upwardly of the conveyors 3 and since their lower passes are synchronously driven with the lower passes 12*a* of the belts 12, the conveyors 15 draw the return loop region 15 and the rollers 16 into the direction of arrow 6 back into the initial position.

Thus both sets of conveyors 3 and 15 are, in the embodiment shown in FIGS. 3 and 4, endless belt conveyors which are driven in the same direction. They may be formed by cog belts and the conveyors 3 can have rollers 16, 17, 18 and 19 in addition to the drive rollers 23. Guide rollers 22 and 22*a* can also be provided for the conveyors 3 (see FIG. 3).

Since all of the conveyors, namely, the conveyors 3 and the conveyors 15 which are closely adjacent the conveyors 3 on the right and left sides thereof, respectively, are all driven by the same motors 24, they are all synchronized with one another.

The buffer loop arrangement shown at 13 for the conveyors 3 can be formed by rollers 25 which are movable in the direction of the double-headed arrow 26 and form doubled back portions of the belt 12 at the fixed rollers 18.

When an effector connected to the roller 16, for example, as represented at $1^6$a, shifts the return loop 14 to the left, the roller 25 is similarly drawn to the left as the buffer loop shortens. The effector 16*a* can be controlled by a detector 16*b* which can be a light curtain or photo cell arrangement which can detect the position of the piece 1' in the region of the deflecting roller 16 or in the region of the roller 17 and can provide an input for the effector 16*a*. The detector 16*b* can respond to a leading or trailing edge of the workpieces.

During the displacement of the loop region 14 in a direction opposite to the transport direction 6, the roller 16 rotates more rapidly although the belt 12 of the conveyor 3 continues to operate at its original constant speed. Upon return of the loop 14 to its initial position, the roller 16 can rotate more slowly, again while the belt speed remains constant. The belt speed must be about 15 to 20 meters per minute.

I claim:

1. An apparatus for conveying flat pieces of a web, comprising:

a first transporter for displacing a web subdividable into a succession of flat pieces of the web along a first path in a first direction;

a second transporter defining a second path in a plane parallel to a plane of said first path for receiving said flat pieces and displacing the received flat pieces in a second direction perpendicular to said first direction; and clamping means engageable with said flat pieces at a location along said first path for transferring said flat pieces to said second path for engagement by said second transporter, said second transporter comprising:

a strip-shaped support extending in said second direction away from a location along said second path at which said flat pieces are transferred from said first path to said second path, a continuously driven first conveyor element having a stretch traveling in said second direction and running along said support for entraining said flat pieces along said support, and further means for displacing at least an up-stream part of said conveyor element toward said location along said second path for receiving a transferred flat piece on said second transporter.

2. The apparatus defined in claim 1 wherein the continuously driven conveyor element is displaceable parallel to but opposite to said second direction from an initial position toward said location and back along said second path for receiving one of said flat pieces on said second transporter.

3. The apparatus defined in claim 1, wherein said means for displacing at least an upstream part of said conveyor element includes an effector connected to a controller for detecting a pattern of the flat piece and a setpoint position of the flat piece under said stretch of said conveyor moving in said second direction.

4. The apparatus defined in claim 1, wherein said means for displacing at least an upstream part of said conveyor element includes an effector connected to a controller for detecting the position of one of said flat pieces beneath said stretch of the conveyor element of the second transporter.

5. The apparatus defined in claim 1, wherein said second transporter has two mutually parallel and transversely spaced apart continuously driven conveyor elements having stretches traveling in said second direction and running along respective strips of said support for entraining said flat pieces along said support, and means for displacing at least an upstream part of each of said conveyor elements toward said location along said second path for receiving one of said flat pieces on said second transporter.

6. The apparatus defined in claim 5 wherein the conveyor elements are cog belts passing over and meshing with driving and deflecting cog wheels.

7. The apparatus defined in claim 1 wherein said conveyor element has a buffer loop and a return loop at an upstream side of said stretch, said further means shifting said return loop parallel to but opposite to said second direction from an initial position to a position for receiving said transferred flat piece on said second transporter.

8. The apparatus defined in claim 7 wherein said conveyor element is provided with a first roller around which said return loop extends and is looped around a second roller and a third roller to form the buffer loop in the form of a double-backed portion of the conveyor element, said first roller and one of said second and third rollers being movable jointly for shifting of said return loop parallel to but opposite to said second direction from said initial position to said position for receiving said transferred flat piece on said second transporter.

9. The apparatus defined in claim 7, further comprising a second continuously driven endless conveyor element alongside the first conveyor element and having a stretch juxtaposed with said support and traveling in direction and with a speed corresponding to a direction and speed of the conveyor element and positioned to engage one of said flat pieces previously engaged by said return loop to draw said return loop back into said initial position.

10. The apparatus defined in claim 9 wherein both of said continuously driven conveyor elements are endless circulating elements.

11. The apparatus defined in claim 9 wherein said conveyor elements are disposed close together and have a common drive for synchronously driving the conveyor elements.

12. An apparatus for forming and conveying flat pieces of a textile web, comprising:

a first transporter including a tongs engageable with a leading edge of a textile web and a transport slider for displacing the textile along a first path in a first direction in one plane;

separating means along said first path for severing flat pieces from said web whereby a succession of said flat pieces from said web are displaced along said first path in said first direction;

a second transporter defining a second path in a second plane parallel to said one plane for receiving said flat pieces and displacing the received flat pieces in a second direction perpendicular to said first direction, said planes being spaced apart; and clamping means engageable with said flat pieces at a location along said first path for transferring said flat pieces to said second path for engagement by said second transporter, said clamping means including pairs of clamps engaging respective flat pieces inwardly of but close to opposite edges of the flat piece, said clamps being engageable with each flat piece in the plane of said first path, being shiftable with the engaged flat piece into the plane of said second path, and being shiftable toward and away from said second transporter, said second transporter being shiftable toward and away from said clamping means.

13. The apparatus defined in claim 12 wherein said clamps and said second transporter approach each other for transfer of a flat piece to said second transporter and are so constructed and arranged that successive flat pieces are advanced in said second transporter practically without gaps between them.

14. The apparatus defined in claim 12 wherein said said second transporter comprises:

a strip-shaped support extending in said second direction away from a location along said second path at which said flat pieces are transferred from said first path to said second path, a respective continuously driven conveyor element having a stretch traveling in said second direction and running along said support and located slightly outwardly of a respective pair of said clamps for entraining respective ones of said edges of a flat piece along said support, and means for displacing at least an upstream part of said conveyor element toward said location along said second path for receiving a transferred flat piece on said second transporter.

15. The apparatus defined in claim 14 wherein said clamps are pairs of clamping bars.

16. The apparatus defined in claim 14 wherein said support is formed by a plate or table.

17. The apparatus defined in claim 14 wherein said support is formed by a continuously driven conveyor.

18. A method of forming and conveying flat pieces of a textile web, comprising the steps of:

(a) gripping a leading edge of said textile web and drawing said textile web in a first direction along a first path in a first plane;

(b) cutting a flat piece from said textile web on said first path in said first plane to define a trailing edge on said flat piece;

(c) engaging said flat piece by two pairs of clamping bars in said first plane with each pair of clamping bars gripping said flat piece inwardly of a respective one of said edges and extending perpendicularly to said direction;

(d) shifting said flat piece clamped by said pairs of clamping bars into a second plane parallel to but spaced from said first plane;

(e) moving said clamping bars with said flat piece clamped thereby in a second direction perpendicular to said first direction to displace the flat piece along a second path in said second plane and moving at least parts of a pair of continuously driven endless conveyor elements having stretches traveling in said second direction, opposite said second direction toward said clamping bars, and engaging said edges between said stretches and elongated supports juxtaposed with said stretches; and (f) thereafter, releasing said flat piece from said clamping bars, moving at least said parts of said pair of continuously driven endless conveyor elements back to an initial position and continuing to displace said flat piece in said second plane in said second direction between said stretches and elongated supports juxtaposed with said stretches.

* * * * *